United States Patent [19]

Olsen

[11] Patent Number: 4,952,160

[45] Date of Patent: Aug. 28, 1990

[54] MARINE HULL INLET FOR ELECTRICAL CABLES

[75] Inventor: Charles A. Olsen, Milford, Conn.

[73] Assignee: Hubbell Incorporated, Orange, Conn.

[21] Appl. No.: 338,677

[22] Filed: Apr. 17, 1989

[51] Int. Cl.[5] ..... H01R 13/44

[52] U.S. Cl. ..... 439/142; 174/67; 220/324; 220/334; 439/271; 439/367; 439/372; 439/373

[58] Field of Search ..... 174/67; 220/324, 326, 220/334; 439/142, 271, 282, 367, 372, 373, 589

[56] References Cited

U.S. PATENT DOCUMENTS

| | | | |
|---|---|---|---|
| 1,268,904 | 6/1918 | White | 220/324 |
| 1,483,953 | 2/1974 | Rainey | 220/334 |
| 2,183,448 | 12/1939 | Drane | 220/334 |
| 3,716,815 | 2/1973 | Riches | 174/67 |
| 4,031,312 | 6/1977 | Coleman et al. | 439/142 |
| 4,355,197 | 10/1982 | Jönsson | 439/142 |

OTHER PUBLICATIONS

Marinco Catalog No. 15-8889; Power Inlet-6372 CR; 1988/1989, p. 4.

Marinco Catalog No. 15-8889; Power Inlet-301 CRl-B; 1988/1989, p. 6, and Sketch.

*Primary Examiner*—Paula A. Bradley

*Attorney, Agent, or Firm*—Jerry M. Presson; Alfred N. Goodman

[57] ABSTRACT

A marine hull inlet assembly for providing a watertight inlet in the hull of a boat to provide a connection point for shore-based power lines, communication lines, and the like. The inlet assembly includes a receptacle member and a sealing assembly. The sealing assembly includes top and bottom covers pivotally connected together with the top cover having a gasket which is pressed against the receptacle for providing the watertight seal. The top and bottom covers are releasably coupled by a latch assembly. The latch assembly is spring-biased so that the top and bottom covers are biased toward each other when in the latched position. The latch assembly may either have a push-type latching element or a quarter turn-type latching element.

19 Claims, 3 Drawing Sheets

MARINE HULL INLET FOR ELECTRICAL CABLES

FIELD OF THE INVENTION

This invention relates to a marine hull inlet to be installed on a boat to provide a connection point for shore-based power lines, communication lines, and other electrical cables. More specifically, the invention relates to a housing that is coupled to a boat hull and has an openable cover, a watertight seal inside the cover, and a spring loaded latch assembly for releasably coupling the cover to the housing and for pressurizing the seal.

BACKGROUND OF THE INVENTION

In the shipping industry, there has been an increased use of running power and communication lines from a base on shore to a boat anchored just off the shore. With this increased use of power lines and communication lines extending to offshore boats, there is an increased need for a way to provide a watertight hull inlet which may be opened and closed regularly for making connections between the boat and the shore-based lines.

While many attempts have been made to provide a connection point on a boat for shore-based power and communication lines, numerous disadvantages are present in these prior devices. Many of them are not waterproof, and thus the electrical connection points become corroded by the sea water. In addition, installation of many of these connection points require extensive modification to the hull of the boat. Moreover, many of these devices require expensive assemblies for attaching them to the hull of the boat.

This invention addresses this need in the art, along with other problems and needs which will become apparent to those skilled in the art once given this disclosure.

SUMMARY OF THE INVENTION

Accordingly, a primary object of the present invention is to provide a marine hull inlet assembly for electrical cables such as power and communication lines that has a watertight seal.

Another object of the present invention is to provide a marine hull inlet assembly that may be attached to the hull of a boat with relatively little modification to the hull.

Still another object of the present invention is to provide a marine hull inlet assembly that is relatively inexpensive to manufacture and install.

Yet another object of the present invention is to provide a marine hull inlet assembly that maintains a watertight seal after many cycles of opening and closing the assembly.

The foregoing objects are basically attained by a marine hull inlet assembly comprising a receptacle member and a sealing assembly including a first member, a second member and a latching assembly. The receptacle member contains the connection points for shore-based power lines, communication lines and the like. The sealing assembly is coupled to the receptacle member for selectively sealing it. The first member of the sealing assembly is adapted to be coupled to the hull of a boat, while the second member is coupled to the first member. The second member has a sealing element coupled thereto for sealing the receptacle. The latching assembly releasably couples the first and second members between latched and unlatched positions. The latching assembly has a latching element movably coupled to the second member for releasably coupling the first and second members together. The latching assembly also includes a biasing member for biasing the first and second members together when in a latched position. This arrangement provides sealing of the receptacle by having the sealing element of the second member engaging the receptacle to maintain a watertight seal therebetween when the assembly is in its latched position.

Other objects, advantages and salient features of the present invention will become apparent from the following detailed description, which, taken in conjunction with the annexed drawings, discloses two preferred embodiments of the present invention.

BRIEF DESCRIPTION OF THE DRAWINGS

Referring to the drawings which form part of this original disclosure.

DETAILED DESCRIPTION OF THE INVENTION

Figure 1:
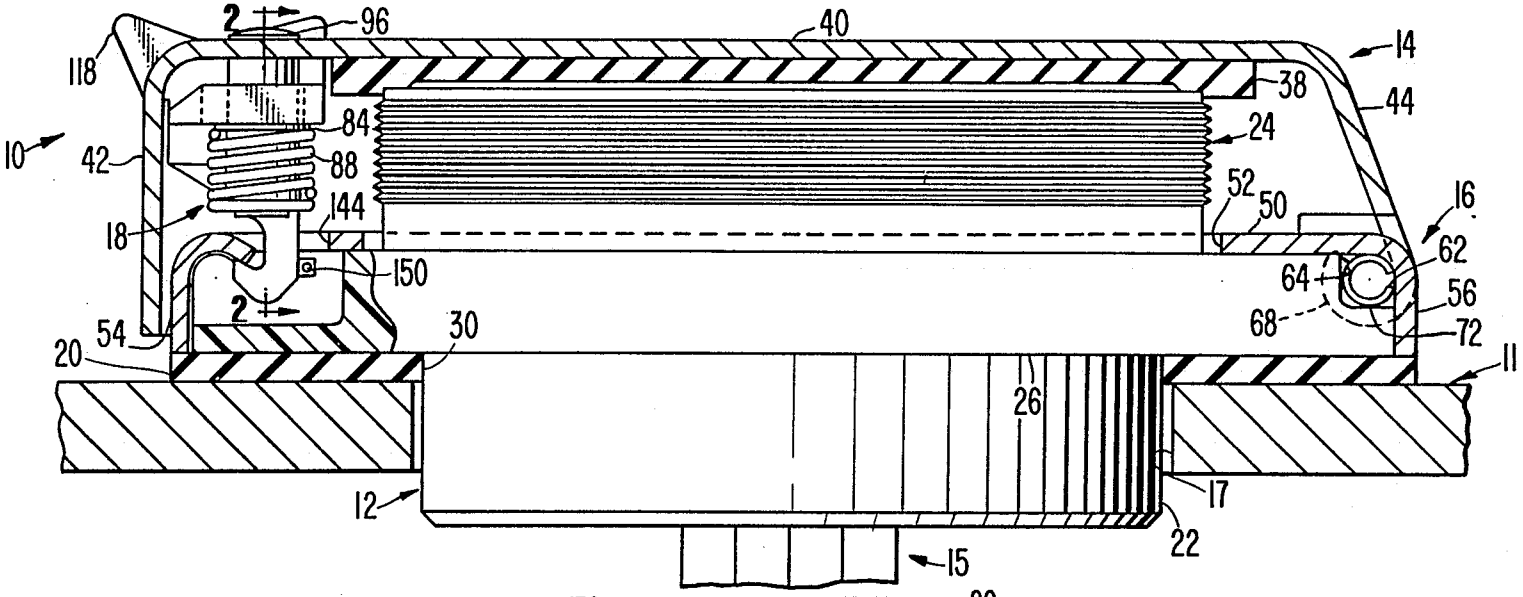
FIG. 1 is a side elevational view of a marine hull inlet assembly in accordance with the present invention with parts in section showing the latch assembly in the latched position.
Figure 2:
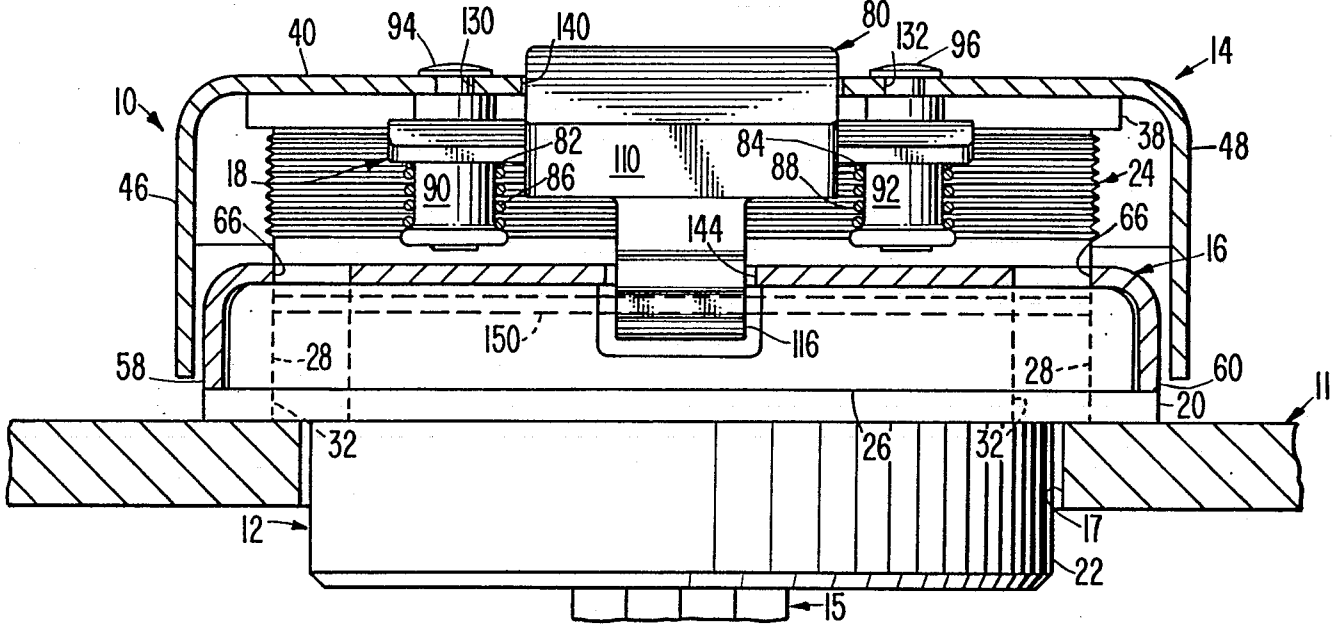
FIG. 2 is a transverse, cross-sectional view in end elevation of the marine hull inlet assembly shown in FIG. 1 taken along line 2—2 in FIG. 1.
Figure 5:
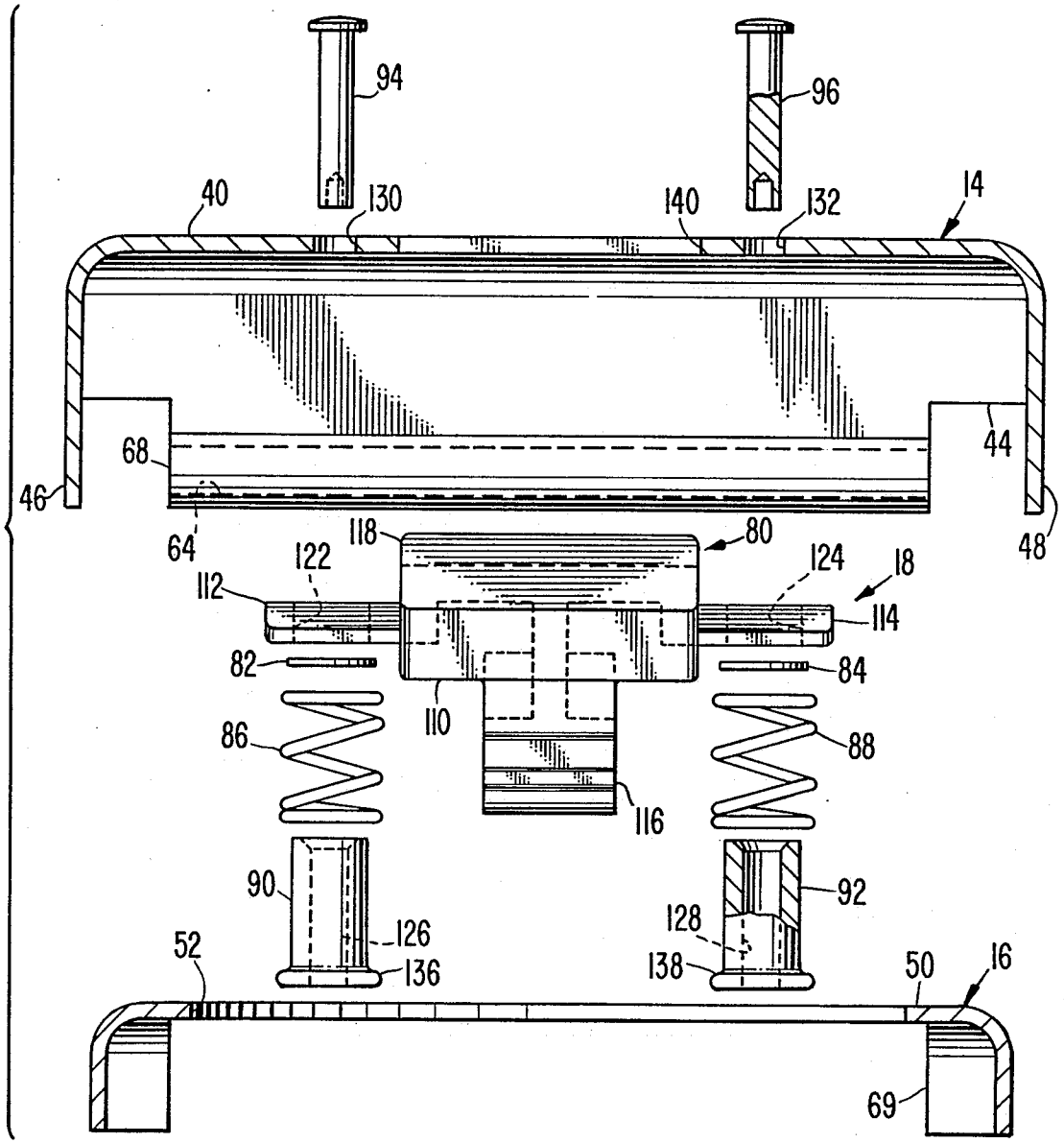
FIG. 5 is an exploded end view of the latch assembly and the top and bottom cover members shown in FIG. 2.

Referring initially to FIGS. 1, 2 and 5, the present invention relates to a marine hull inlet assembly 10 providing a watertight inlet on a boat hull 11 for shore-based electrical cables such as power lines, communication lines and the like. The marine hull inlet assembly 10 includes a receptacle member 12, a top cover 14, a bottom cover 16, a latch assembly 18 and a base gasket 20.

The receptacle member 12 includes an inlet base 22 in the form of a cup containing power and communication contacts for electrical cables 15 inside the boat, an externally threaded hub 24, and a rectangular mounting flange 26, which is preferably integrally formed with the hub. The inlet base 22 is preferably coupled to the flange 26 via a suitable snap-fit in an internal bore therein aligned with the hub. The inlet base 22 is received in an opening 17 in hull 11. The inlet base 22, the hub 24, and flange 26 are preferably formed of plastic material or any other suitable material.

The inlet base 22 has the rectangular mounting flange 26 extending about its periphery. The mounting flange 26 has four mounting bores 28 (only two shown in FIG. 2) extending therethrough for receiving mounting screws (not shown) to secure the assembly 10 to the hull 11 of a boat.

The top cover, or first member, 14 includes a rubber sealing element 38 coupled to the bottom of its top planar wall 40 by an adhesive or the like. The top cover 14 is rectangular and has four planar side walls 42, 44, 46 and 48 extending downwardly from its top wall's periphery. The top cover 14 is advantageously formed of a corrosion resistant metal or any other corrosion resistant material.

The bottom cover, or second member, 16 includes an upper planar wall 50 having a circular opening 52 extending therethrough and four side walls 54, 56, 58 and 60 extending downwardly from upper wall 50. The bottom cover 16 is generally rectangular, having a mounting hole 66 at each corner. The four mounting holes 66 are aligned with the four mounting bores 28 of the inlet base mounting flange 26 for receiving the mounting screws therethrough to secure assembly 10 to the hull 11 of a boat. The bottom cover 16 is advantageously formed of a corrosion resistant metal or any other suitable corrosion resistant material. The circular opening 52 is large enough to permit the upper portion of receptacle member 12 to pass therethrough, but smaller than mounting flange 26 to retain the receptacle member 12 against the hull of the boat when mounted thereon.

The base gasket 20 is preferably formed of rubber and is generally rectangular in shape with a circular opening 30 extending therethrough. The circular opening 30 receives the inlet base 22 therein. The base gasket 20 also has an opening 32 at each corner, which are aligned with bores 28 and holes 66, for receiving the mounting screws therethrough. The base gasket 20 provides a watertight seal between the hull of the boat and the marine hull inlet assembly 10.

The top cover 14 and the bottom cover 16 are pivotally coupled together at one end by a spring pin 62. Spring pin 62 is retained in a circular slot 64 seen in FIGS. 1 and 5 formed by bending the free end 68 of the back side wall 44 upwardly into a C-shape. The back side wall 44 extends into a cutout 69 in the bottom cover 16. The spring pin 62 has a length which spans the length of the cutout 69 so that top cover 14 and bottom cover 16 pivot relative to one another. The mounting flange 26 includes a recessed portion 72 for engaging the free end 68 of the top cover 14 to maintain spring pin 62 up against the bottom cover 16, as shown in FIG. 1.

Referring particularly to FIG. 5, the latch assembly 18 includes a latching element 80, a pair of washers 82 and 84, a pair of springs 86 and 88, a pair of spacers 90 and 92, and a pair of rivets 94 and 96.

The latching element 80 includes a body portion 110 having a pair of side flanges 112 and 114 extending substantially perpendicularly and outwardly from the sides of body portion 110. A hook member 116 extends downwardly from the center of body portion 110, while a pair of shoulders 118 and 120 extend upwardly from the body portion 110 as seen in FIGS. 3–6.

Figure 3:
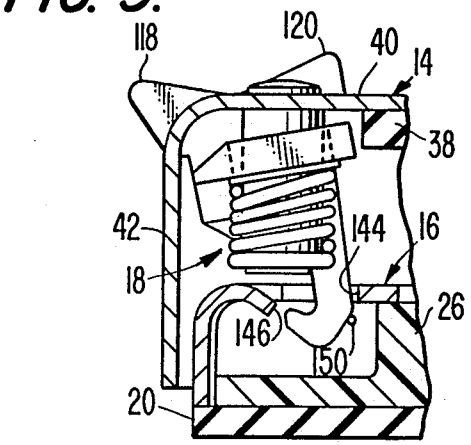
FIG. 3 is a partial, cross-sectional view in side elevation of the latch assembly of FIGS. 1 and 2 just prior to being released.
Figure 6:
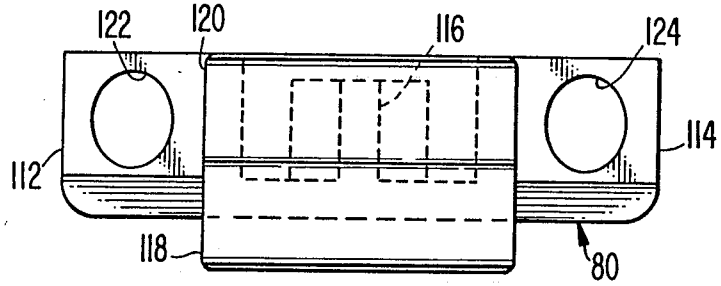
FIG. 6 is a top plan view of the latching element of the latch assembly.

Referring particularly to FIG. 6, flanges 112 and 114 each include an elliptical bore or opening 122 and 124, respectively. Elliptical openings 122 and 124 permit cylindrical spacers 90 and 92 to pass therethrough, respectively. Since openings 122 and 124 are elliptical, latching element 80 can pivot or rock about an axis transverse to the longitudinal axis of spacers 90 and 92, as seen in FIG. 3.

The spacers 90 and 92 each include a throughbore 126 and 128, respectively. The bores 126 and 128 permit the rivets 94 and 96 to pass therethrough.

As seen in FIGS. 1 and 2, the latch assembly 18 is secured to the top cover 14 by rivets 94 and 96 extending through openings 130 and 132 in the top wall 40 of top cover 14. The rivets 94 and 96 extend downwardly through bores 126 and 128 in spacers 90 and 92 with spacers 90 and 92 extending through elliptical openings 122 and 124 in latching element 80. The rivets 94 and 96 are then peened to hold spacers 90 and 92 in firm contact with the top cover 14. The coiled compression springs 86 and 88 are retained about the spacers 90 and 92 by shoulders 136 and 138, respectively, and the flanges 112 and 114. Spacers 90 and 92 maintain the springs 86 and 88 under compression to bias the latching element 80 upwardly towards the top cover 14.

The shoulders 118 and 120 of the latching element 80 extend through a rectangular opening 140 in the top cover 14 seen in FIGS. 1 and 2. The assembly 10 is unlatched or latched by pushing on shoulders 118 and 120.

Figure 4:
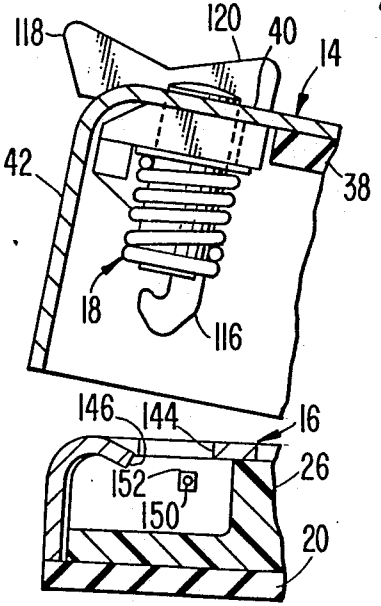
FIG. 4 is a partial, cross-sectional view in side elevation of the latch assembly of FIGS. 1–3 in its unlatched position.

The bottom cover 16 as seen in FIGS. 1, 3 and 4 includes an opening 144 for receiving hook member 116 of the latching element 80. A hook portion 146 is formed by bending downwardly a portion of the base cover 16 adjacent to opening 144 for engaging hook member 116 when in its latched position, as seen in FIG. 1. A wire spring, or biasing element, 150 is maintained in a transversely extending bore 152 in mounting flange 26. This wire spring 150 is positioned adjacent opening 144 to deflect in a transverse direction when engaged by hook member 116, as seen in FIGS. 1–4 and keep the latching element 80 from unlocking due to shock and vibration.

In operation, to unlatch the top cover 14 from bottom cover 16, the operator pushes down on shoulder 118, causing latching element 80 to pivot about an axis transverse to the longitudinal axis of spacers 90 and 92, as seen in FIG. 3. This movement causes hook member 116 to move backwards, deflecting wire spring 150 backwards, and thus disengaging hook member 116 from hook portion 146 to allow hook member 116 to pass outwardly from opening 144. The top cover can then be pivoted open, and shore-based electrical cables can be coupled to the connection points of cables 15 inside receptacle member 12 and secured to hub 24 via a suitable internally threaded ring coupled thereto which threadedly engages the hub.

To latch the top cover 14 to bottom cover 16 once the shore-based cables are removed, the operator pivots top cover 14 so as to overlie bottom cover 16 and pushes down on shoulder 120. By pushing on shoulder 120, the latching element 80 moves down against the force of springs 86 and 88, and then deflects wire spring 150 backwards so as to permit hook member 116 to pass through opening 144 and engage hook portion 146.

EMBODIMENT OF FIGS. 7–9

Figure 9:
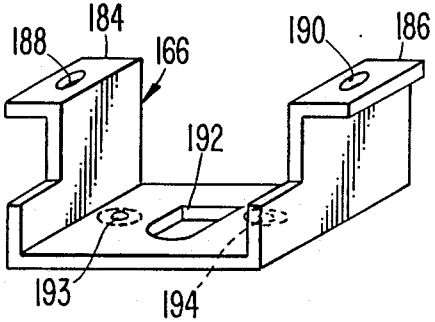
FIG. 9 is right perspective view of the spring retaining bracket of the latch assembly of the second embodiment.
Figure 8:
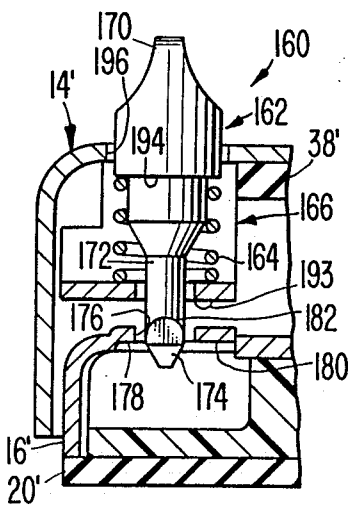
FIG. 8 is a partial, cross-sectional side view in elevation of the second embodiment of the latch assembly in its unlocked position.
Figure 7:
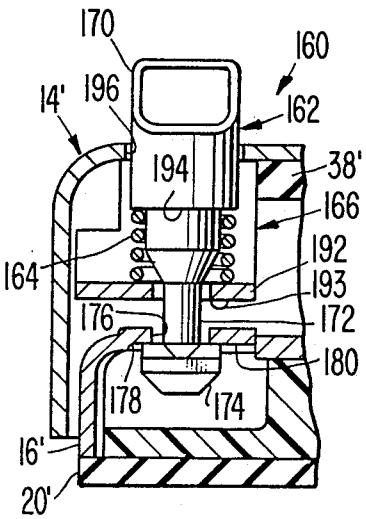
FIG. 7 is a partial, cross-sectional view in side elevation of a second embodiment of a latch assembly in accordance with the present invention, with the latch assembly in its locked position.

Referring now to the second embodiment shown in FIGS. 7–9, this embodiment is substantially identical to the embodiment shown in FIGS. 1–6, except for the latching assembly and the way the latching assembly is coupled to the top and bottom covers. Latching assembly 160 is used in this embodiment having a latching element 162, a compression spring 164, and a spring retaining member 166. The elements of the second embodiment which are the same as those in the first embodiment are given the same reference numerals with the addition of a prime.

The latching element 162 includes a handle portion 170, a downwardly extending shaft 172, and a locking member 174. The shaft 172 and the locking member 174 form a T-shaped latch which is received in a slot or opening 176 in the bottom cover 16'.

The slot 176 is rectangular in shape and sized to retain locking member 174 in its locked position as seen in FIG. 7 and to permit locking member 174 to pass freely therethrough when turned ninety degrees to its unlocked position, as seen in FIG. 8.

A pair of downwardly opening recesses 178 and 180 are formed adjacent to the long sides of slot 176 for receiving locking member 174 therein. These recesses have generally a curved transverse cross section corresponding to the curved upper surface 182 of locking member 174.

Referring to FIG. 9, the retaining member 166 is generally U-shaped, having a pair of mounting flanges 184 and 186 with mounting holes 188 and 190 extending therethrough. The mounting holes 188 and 190 receive a pair of rivets or any other suitable fasteners to secure retaining member 166 to the top cover 14'. A cutout 192 is provided in the base of retaining member 166 for receiving shaft 172 of latching element 162. On opposite sides of cutout 192 are a pair of downwardly extending dimples 193 and 194, which keep locking member 174 from rotating out of position when in the unlocked position, as seen in FIG. 8.

The compression spring 164 is retained about latching element 162 by retaining member 166 and a shoulder 194 formed between handle portion 170 and shaft 172.

As seen in FIGS. 7 and 8, the handle portion 170 extends through circular opening 196 in cover 14' to permit an operator to turn the latching element 160 ninety degrees to latch or unlatch the top cover 14' to the bottom cover 16'.

While only two embodiments have been chosen to illustrate the invention, it will be understood by those skilled in this art that various changes and modifications can be made herein without departing from the scope of the invention as defined in the appended claims.

What is claimed is:

1. A marine hull inlet assembly adapted to be mounted to the hull of a boat for providing a connection point on the boat for shore-based electrical cables, the combination comprising:

receptacle means for containing therein connection points for shore-based electrical cables; and means, coupled to said receptacle means, for selectively sealing said receptacle, said means for selectively sealing comprising a first member adapted to be coupled to the hull of the boat, a second member coupled to said first member, said second member having a sealing element coupled thereto, a latching assembly for releasably coupling said first and second members between latched and unlatched positions, said latching assembly having a latching element movably coupled to said second member for releasably coupling said first and second members together and means for biasing said first and second members together when in said latched position, and a biasing element positioned adjacent said latching element when in said latched position, said biasing element applying pressure to said latching element when said latching element moves between said latched and unlatched positions, whereby said sealing element engages said receptacle means to maintain a watertight seal therebetween, when said first and second members are in said latched position.

2. A marine hull inlet assembly according to claim 1, wherein said latching element includes a flange for engaging said means for biasing to bias said latching element toward said second member.

3. A marine hull inlet assembly according to claim 1, and further comprising means for pivotally coupling said first and second members at one end thereof, said latching assembly being located at the other end of said first and second members.

4. A marine hull inlet assembly according to claim 1, wherein said means for biasing includes at least one spring.

5. A marine hull inlet assembly according to claim 4, and further comprising means for maintaining said spring under compression when said first and second members are in said latched position.

6. A marine hull inlet assembly adapted to be mounted to the hull of a boat for providing a connection point on the boat for shore-based electrical cables, the combination comprising:

receptacle means for containing therein connecting points for shore-based electrical cables; and means, coupled to said receptacle means, for selectively sealing said receptacle, said means for selectively sealing comprising a first member adapted to be coupled to the hull of the boat, a second member coupled to said first member, said second member having a sealing element coupled thereto, a latching assembly for releasably coupling said first and second members between latched and unlatched positions, said latching assembly having a latching element movably coupled to said second member for releasably coupling said first and second members together and means for biasing said first and second members together when in said latched position, said latching element including a flange for engaging said means for biasing to bias said latching element toward said second member, and spacing means, coupled to said second member and extending through a bore in said flange, for retaining said means for biasing against said flange, whereby said sealing element engages said receptacle means to maintain a watertight seal therebetween, when said first and second members are in said latched position.

7. A marine hull inlet assembly according to claim 6, wherein said bore is sized to permit said latching element to slide longitudinally along said spacing means and to pivot about an axis transverse to said spacing means longitudinal axis.

8. A marine hull inlet assembly according to claim 6, wherein said bore is elliptical.

9. A marine hull inlet assembly adapted to be mounted to the hull of a boat for providing a connection point on the boat for shore-based electrical cables, the combination comprising:

receptacle means for containing therein connection points for shore-based electrical cables; and means, coupled to said receptacle means, for selectively sealing said receptacle, said means for selectively sealing comprising a first member adapted to be coupled to the hull of the boat, a second member coupled to said first member, said second member having a sealing element coupled thereto, and a latching assembly for releasably coupling said first and second members between latched and unlatched positions, said latching assembly having a latching element movably coupled to said second member for releasably coupling said first and second members together and means for biasing said first and second members together when in said latched position, said latching assembly including a pair of flanges extending from said latching element and having a bore extending through each of said flanges, and said latching assembly further including a pair of spacing members, each having one end coupled to said second member with said latching element slidably and pivotally coupled thereto and its other end retaining said biasing means thereon, whereby said sealing element engages said receptacle means to maintain a watertight seal therebetween, when said first and second members are in said latched position.

10. A marine hull inlet assembly adapted to be mounted to the hull of a boat for providing a connection point on the boat for shore-based electrical cables, the combination comprising:

receptacle means for containing therein connection points for shore-based electrical cables; and means, coupled to said receptacle means, for selectively sealing said receptacle, said means for selectively sealing comprising a first member adapted to be coupled to the hull of the boat, a second member coupled to said first member, said second member having a sealing element coupled thereto, and a latching assembly for releasably coupling said first and second members between latched and unlatched positions, said latching assembly having a latching element movably coupled to said second member for releasably coupling said first and second members together and means for biasing said first and second members together when in said latched position, said first member having an opening for releasably coupling said latching element therein, and said latching element being T-shaped and rotatably coupled to said second member about its longitudinal axis for releasably engaging said first member when located in said opening and in said latched position, and for uncoupling said latching element from said latched position to said unlatched position by rotating said latching element about its longitudinal axis, whereby said sealing element engages said receptacle means to maintain a watertight seal therebetween, when said first and second members are in said latched position.

11. A latch assembly for use with a marine hull inlet assembly, the combination comprising:

first and second members;

a latching element movably coupled to said second member, said latching element being movable to releasably latch said first and second members;

biasing means, coupled to said second member, for engaging said latching element;

means for compressing said biasing means, when said latching element is in its latched position, to bias said first and second members toward each other; and a biasing element positioned adjacent said latching element when in said latched position, said biasing element applying pressure to said latching element when said latching member moves between said latched and unlatched positions.

12. A latch assembly according to claim 11, wherein said latching element includes a flange for engaging said means for biasing to bias said latching element toward said second member.

13. A latch assembly according to claim 11, wherein said means for biasing includes at least one spring.

14. A latch assembly according to claim 13, and further comprising compression means for maintaining said spring under compression when in said latched position.

15. A latch assembly for use with a marine hull inlet assembly, the combination comprising:

first and second members;

a latching element movably coupled to said second member, said latching element being movable to releasably latch said first and second members;

biasing means, coupled to said second member, for engaging said latching element;

said latching element including a flange for engaging said means for biasing to bias said latching element toward said second member, means for compressing said biasing means, when said latching element is in its latched position, to bias said first and second members toward each other; and spacing means, coupled to said second member and extending through a bore in said flange, for retaining said means for biasing against said flange.

16. A latch assembly according to claim 15, wherein said bore is sized to permit said latching element to slide longitudinally along said spacing means and to pivot about an axis transverse to said spacing means longitudinal axis.

17. A latch assembly according to claim 16, wherein said bore is elliptical.

18. A latch assembly for use with a marine hull inlet assembly, the combination comprising:

first and second members;

a latching element movably coupled to said second member, said latching element being movable to releasably latch said first and second members;

biasing means, coupled to said second member, for engaging said latching element; and means for compressing said biasing means, when said latching element is in its latched position, to bias said first and second members toward each other, said latching element including a pair of flanges extending therefrom and having a bore extending through each of said flanges, and said latch assembly further including a pair of spacing members, each having one end coupled to said second member with said latching element slidably and pivotally coupled thereto and its other end retaining said biasing means thereon.

19. A latch assembly for use with a marine hull inlet assembly, the combination comprising:

first and second members;

a latching element movably coupled to said second member, said latching element being movable to releasably latch said first and second members;

biasing means, coupled to said second member, for engaging said latching element; and means for compressing said biasing means, when said latching element is in its latched position, to bias said first and second members toward each other;

said first member having an opening for releasably coupling said latching element therein, and said latching element being T-shaped for releasably engaging said first member when located in said opening and in said latched position, and for uncoupling said latching element from said latched position and by rotating said latching element about its longitudinal axis.

* * * * *